US008215399B2

(12) United States Patent
Bussear et al.

(10) Patent No.: US 8,215,399 B2
(45) Date of Patent: Jul. 10, 2012

(54) DOWNHOLE SHUT OFF ASSEMBLY FOR ARTIFICIALLY LIFTED WELLS

(75) Inventors: Terry R. Bussear, Spring, TX (US); Kirk J. Huber, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 12/141,398

(22) Filed: Jun. 18, 2008

(65) Prior Publication Data

US 2009/0314499 A1 Dec. 24, 2009

(51) Int. Cl.
*E21B 33/12* (2006.01)

(52) U.S. Cl. ..... 166/313; 166/184; 166/334.1; 166/381

(58) Field of Classification Search ..... 166/51, 166/77, 89.1, 131, 184, 191, 313, 334.1, 166/381, 77.1, 143, 133, 188, 97.5
See application file for complete search history.

(56) References Cited

U.S. PATENT DOCUMENTS

| | | | | | |
|---|---|---|---|---|---|
| 3,115,187 | A | * | 12/1963 | Brown | 166/316 |
| 3,799,268 | A | * | 3/1974 | Cochran | 166/313 |
| 4,440,221 | A | * | 4/1984 | Taylor et al. | 166/106 |
| 4,440,231 | A | | 4/1984 | Martin | |
| 4,682,655 | A | | 7/1987 | Rivas | |
| 5,024,275 | A | | 6/1991 | Anderson et al. | |
| 5,320,176 | A | | 6/1994 | Naquin | |
| 6,119,780 | A | * | 9/2000 | Christmas | 166/313 |
| 6,328,111 | B1 | | 12/2001 | Bearden et al. | |
| 6,415,864 | B1 | | 7/2002 | Ramakrishnan et al. | |
| 7,228,914 | B2 | * | 6/2007 | Chavers et al. | 166/386 |
| 2005/0092501 | A1 | * | 5/2005 | Chavers et al. | 166/386 |
| 2008/0223585 | A1 | * | 9/2008 | Patel et al. | 166/385 |

OTHER PUBLICATIONS

Robison, C.E., et al., "An Alternative Method of Installing ESP's", SPE 25571, Apr. 1993, 455-464.
Dinkins, Walter, et al, "Thur-Tubing Conveyed ESP Pump Replacement—Live Well Intervention", SPE 116822, Sep. 2008, 1-15.
Patterson, John C., et al., "First 4.5-" Through-Tubing SPE with Downhole Wet Connect", SPE 123996, Oct. 2009, 1-13.

* cited by examiner

*Primary Examiner* — William P Neuder
*Assistant Examiner* — Robert E Fuller
(74) *Attorney, Agent, or Firm* — Steve Rosenblatt

(57) ABSTRACT

A multi-string well has an electric submersible pump (ESP) that can be removed without killing the well. A slotted liner is sealingly secured externally to casing and internally to a guide string that remains in the wellbore when the ESP is removed. A ported sub is part of the guide string and a concentric screen that can have instruments that moves relatively to the guide string can selectively allow flow in an annulus between them and to the ported sub or that annulus between the guide and concentric strings can be blocked off by manipulation of the concentric string to close the ported sub. With the lower portion of the well now blocked off, the wellhead can be removed so that the ESP can come out with the production string. The device has particular application to steam assisted gravity drainage (SAGD) systems as well as other downhole applications.

20 Claims, 2 Drawing Sheets

BY

DOWNHOLE SHUT OFF ASSEMBLY FOR ARTIFICIALLY LIFTED WELLS

FIELD OF THE INVENTION

The field of the invention is multi-string wells that require removal of a string without killing the well.

BACKGROUND OF THE INVENTION

For a variety of reasons wells can have multiple strings. One more recent example involves steam assisted gravity drainage (SAGD) installations used to recover tar sands from shallow formations. These installations use wells in combination. An injection well extends horizontally through a formation and is used to deliver steam into the formation to get the tar sands into a flowing condition as the heat added reduces viscosity. The production well is also run horizontally in the same formation and is generally below the injection well. The heated tar sands, from the steam from the injection well, flow into the production well for removal to the surface and further processing.

FIG. 5 is the current way production wells are configured in SAGD service and illustrate the problem addressed by the present invention. FIG. 5 shows a producer well W having a top casing 10 that is sealed with cement 12 and an intermediate casing 14 sealed with cement 16. The intermediate casing 14 terminates at 18 and beyond that is open hole 20. A production string 22 has an electric submersible pump (ESP) 24 at its lower end. A slotted liner 26 extends into open hole 20 and is hung at hanger 28. There is a closed end 30 on the slotted liner 26. A guide string 32 extends from the surface 34 and within the slotted liner 26 and well into the open hole 20. An instrument string 36 runs beyond end 38 of the guide string 32. Instrument string 36 is sealed at the lower end 40 and inside of it are instruments and sensors 42 that can detect temperature, pressure or other well conditions. These sensors are protected in the instrument string 36 from the harsh conditions in the open hole portion 20. It is preferred to put the ESP 24 within the intermediate casing 32 rather than in the open hole portion 20 in the event the ESP 24 needs to be removed for any reason.

Those skilled in the art will appreciate that normally without steam injection, there is no flow in the producer well W. In order to make the tar sands flowable the producer well needs to be heated from the injector well and from steam delivered to the producer well. This is a very slow process that can take months. Once the producer well is at temperature it is full with steam and condensate. If the ESP 24 develops a problem and needs to be removed the well W first had to be killed with water added from the surface 34 before a wellhead (not shown) could be removed so that the ESP 24 could come out. If the wellhead were simply removed and the well W were still live, the condensate in the open hole 20 would experience a pressure reduction and flash to steam and come out at the surface 34 since the wellhead was no longer in position. This would create a very dangerous condition at the surface. The alternative now available is killing the well with fluid before taking off the wellhead so that the flashing of condensate doesn't occur at the surface and possibly injure personnel. The problem with killing the well is that it takes so long to reheat it after it cools and it potentially does not produce as well even after it is put back in service after a months long warm up.

The present invention seeks to provide a way to remove the ESP 24 without having to kill the well W. The downhole equipment is reconfigured to provide a seal between the casing and the slotted liner and another seal between the guide string and the inside of the slotted liner. The guide string features internal seal bores and a ported sub or a sleeve type valve that allows flow to the ESP for production but cuts off flow to the ESP when the concentric string which could hold instruments is moved with respect to its surrounding guide string. With the well isolated below the ESP the production string with the ESP at its lower end can be pulled without killing the well as will be explained in detail below.

U.S. Pat. No. 6,328,111 is relevant to inserting an ESP into a live well that has a single string.

SUMMARY OF THE INVENTION

A multi-string well has an electric submersible pump (ESP) that can be removed without killing the well. A slotted liner is sealingly secured externally to casing and internally to a guide string that remains in the wellbore when the ESP is removed. A ported sub is part of the guide string and a concentric string which could hold instruments string that moves relatively to the guide string can selectively allow flow in an annulus between them and to the ported sub or that annulus between the guide and concentric string which could hold instruments can be blocked off by manipulation of the concentric string to close the ported sub. With the lower portion of the well now blocked off, the wellhead can be removed so that the ESP can come out with the production string. The device has particular application to steam assisted gravity drainage (SAGD) systems as well as other downhole applications.

DETAILED DESCRIPTION OF THE PREFERRED EMBODIMENT

Figures 1, 2, 3, 4, 5:
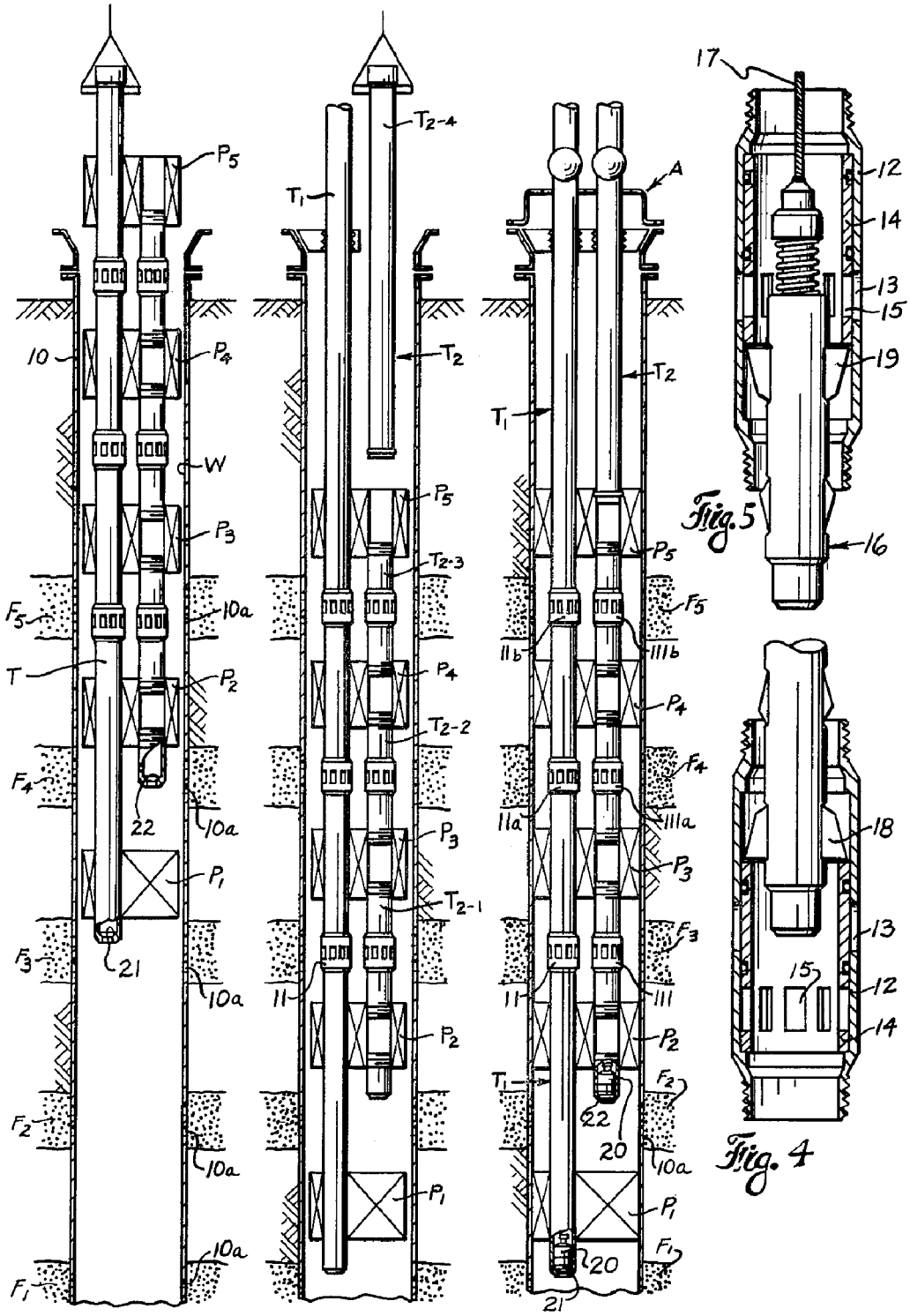
FIG. 1 shows the production mode where flow can reach the ESP from further downhole.
FIG. 2 is the view of FIG. 1 after the concentric string is shifted up to isolate the ESP from the hole below it.
FIG. 3 is a view of a lift cylinder corresponding to the production position of FIG. 1.
FIG. 4 is the view of the lift cylinder corresponding to the shut off position in FIG. 2.
FIG. 5 is a prior art view of an SAGD producer well where killing the well was required to remove the ESP.
Figure 5:
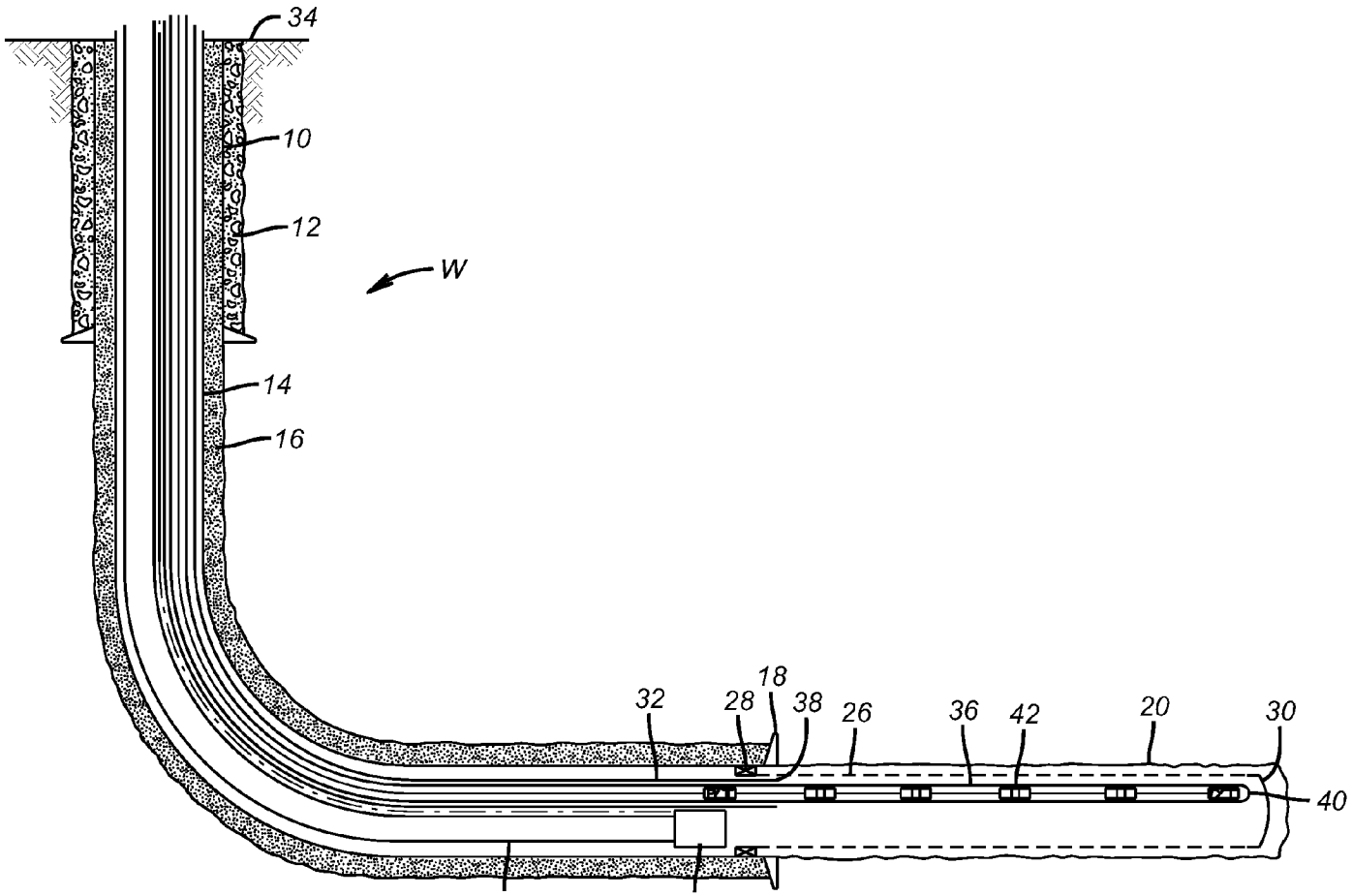
(PRIOR ART) FIG. 5
Figure 1:
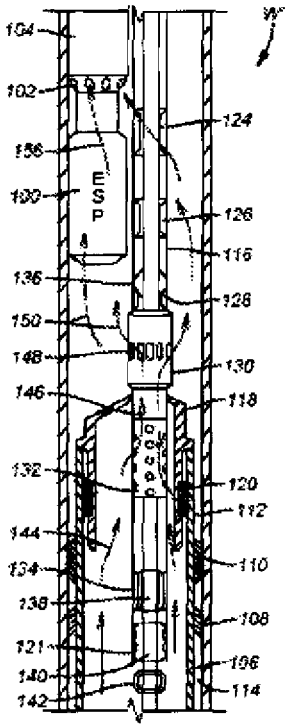
Figure 2:
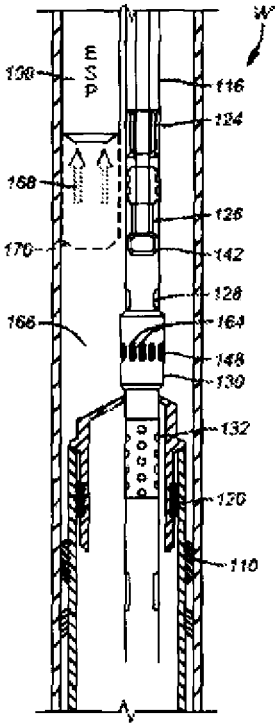
Figure 3:
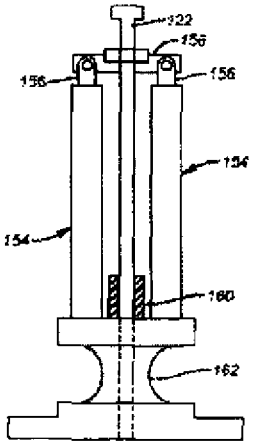
Figure 4:
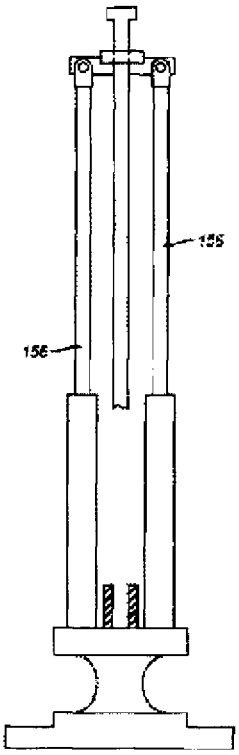

FIG. 1 shows a reconfigured well W' at its lower end. ESP 100 has inlets 102 leading to the production string 104 that runs to the surface (not shown). The upper portions of well W' in FIG. 1 are the same as well W' except in ways to be described below. Slotted liner 106 is anchored at 108 and sealed at 110 to casing 112 thus closing off annulus 114. Guide string 116 has a sealed skirt 118 secured to it. Seal 120 seals the outside of the skirt 118 to the inside of the slotted liner 106. Guide string 116 ends at lower end 121 and concentric string 122 which could hold instruments 123 continues to extend further into slotted liner 106 in the same manner as described for FIG. 5. In this manner seals 110 and 120 constitute an isolation device between the production string 104 and the slotted liner 106 that is in an open hole communicating to the surrounding formation.

Starting at the uphole end, the guide string 116 features internal seal bores 124 and 126 followed by a landing shoulder 128. Below that is a sliding sleeve ported sub 130 shown in the open position in FIG. 1. Further downhole on the guide string 116 is a perforated sub or screen 132 and then another seal bore 134.

On the concentric string 122 there is a no go 136 shown resting on shoulder 128 in FIG. 1. Further down is a seal section 138 that is shown in the seal bore 134 in FIG. 1. Below seal section 138 is a shifting tool 140 and a lower no go 142.

Arrows 144 indicate how flow that got through the slotted liner 106 progresses through the perforated sub or screen 132 as indicated by arrow 146, Once inside the perforated sub 132 flow is free to pass through the open ports 148 as indicated by arrows 150 and then into the ESP 100 as indicated by arrows 152. In the FIG. 1 position the presence of seal section 138 in seal bore 134 closes off the lower end 121 of guide string 116. This redirects flow into the perforated sub 132 and then through open ports 148 to reach the ESP 100.

As stated before, the concentric string 122 is shiftable at the surface using hydraulic cylinders 154 that are connected to pistons 156 which are in turn connected to yoke 158 that supports the concentric string 122. Concentric string 122 is sealed at 160 in wellhead 162. Locally available hydraulic pressure can be applied and removed to attain the positions of FIGS. 3 and 4. The FIG. 3 position of the pistons 156 corresponds to the FIG. 1 position of the components further downhole. Similarly, the FIG. 4 position of the pistons 156 corresponds to the FIG. 2 position that will be described below. Again surface equipment can actuate the pistons 156 between the down position of FIG. 3 and the up position of FIG. 4 in a known manner.

FIG. 2 is the isolation or shut off position that allows removal of the ESP 100 without killing the well. Moving up the concentric string 122 from the surface as described above raises the seal section 138 from seal bore 134 to seal bore 124. No go 142 clears shoulder 128 and stops at seal bore 126 to position the seal section 138 properly in seal bore 124. The upward passage of shifting tool 140 through sliding sleeve ported sub 130 shifts its internal sleeve 164 now visible in closed ports 148. Accordingly, with seal section 138 in seal bore 124 the guide string 116 is blocked. With seals 120 and 110 being where they are there is no access from within the slotted liner 106 to the ESP 100. The wellhead 162 can be removed after water or another fluid is added to the annulus 166 without killing the well that is now isolated as described above. Arrows 168 and dashed line 170 show that the ESP 100 is now safe to remove while the well W' is maintained warm by injection of steam from a nearby injector well. After the ESP 100 is repaired or replaced and lowered back into position and the wellhead 162 is replaced, the cylinders 154 can be activated to retract the pistons 156 to allow the components to reverse their movement to resume the FIG. 1 position for continued production without a warm up delay or with a far shorter delay than warming up a totally cold well.

Those skilled in the art will appreciate that the preferred embodiment of the present invention uses the strings normally in a producer well in a SAGD system and allows ESP removal without killing the well. More broadly the present invention is an isolation system in multi-string wells to allow a string and associated equipment to be removed without killing the well. While SAGD is an illustrated application other downhole multi-string well configurations can have the benefit of the present invention. While a sliding sleeve valve is illustrated and operated with a shifting tool other valve types are contemplated for example flappers and 90 degree ball valves to mention a few.

In SAGD service, the system keeps the basic components of a production string with an ESP at its lower end and a guide string for the concentric string. At the same time with some reconfiguration of the guide and the instrument strings the open hole portion of the producer well can be selectively isolated to allow removal of the wellhead and the production string with the ESP without having to kill the well. This allows the producer well to be kept warm while the ESP is replaced and minimizes subsequent performance degradation in putting a killed well back on line. The warm up that would otherwise take months is also dramatically shortened saving the operator workover costs and allowing production to resume that much sooner. The illustrated assembly can also be used in an injection well with the flows reversed in direction and the ESP replaced with another downhole tool.

The above description is illustrative of the preferred embodiment and many modifications may be made by those skilled in the art without departing from the invention whose scope is to be determined from the literal and equivalent scope of the claims below.

We claim:

1. A completion assembly for a wellbore, comprising a first tubular string extending at least part way into a wellbore and supporting at least a portion of a pump;

at least one additional tubular string extending further into the wellbore and supporting an isolation device that divides the wellbore into an upper zone where said first string is disposed without contact of said isolation device and a lower zone exposed to a formation and where said first string does not extend, the at least one additional string comprising a valve which selectively allows flow through said isolation device to reach a lower end of said first string;

the at least one additional string selectively separable adjacent said isolation device into upper and lower segments along its length in said upper zone with said valve remaining on said lower segment to allow said first string with said at least a portion of a pump and said upper segment to be removed from the wellbore while said lower zone is isolated with said valve.

2. The assembly of claim 1, wherein:

the at least one additional string extends through said isolation device and selectively allows flow through itself to bypass said isolation device by flowing through said valve to reach said first string.

3. The assembly of claim 2, wherein:

said valve on the at least one additional string comprises at least one port on each of opposed sides of said isolation device and a closure for at least one said port on one of said sides.

4. A completion assembly for a wellbore, comprising a first tubular string extending at least part way into a wellbore and supporting at least a portion of a pump;

at least one additional string extending further into the wellbore and supporting an isolation device that divides the wellbore into an upper zone where said first string is disposed without contact of said isolation device and a lower zone exposed to a formation, the at least one additional string selectively allowing flow through said isolation device;

an upper segment of the at least one additional string separates from said isolation device adjacent said isolation device;

the at least one additional string extends through said isolation device and selectively allows flow through itself to bypass said isolation device and reach said first string;

the at least one additional string comprises at least one port on each of opposed sides of said isolation device and a closure for at least one port on one of said sides;

the at least one additional string comprises nested inner and outer strings and said at least one port on each of opposed sides of said isolation device are located on spaced ported subs communicating to an annular space between said inner and outer strings.

5. The assembly of claim 4, wherein:

relative movement between said inner and outer strings causes said closure to close said at least one port on one of said sides.

6. The assembly of claim 5, wherein:

said relative movement is longitudinal movement of said inner string.

7. The assembly of claim 6, wherein:

said closure is a sliding sleeve operated by a shifting tool on said inner string.

8. A completion assembly for a wellbore, comprising a first tubular string extending at least part way into a wellbore and supporting at least a portion of a pump;

at least one additional string extending further into the wellbore and supporting an isolation device that divides the wellbore into an upper zone where said first string is disposed without contact of said isolation device and a lower zone exposed to a formation, the at least one additional string selectively allowing flow through said isolation device;

the at least one additional string extends through said isolation device and selectively allows flow through itself to bypass said isolation device and reach said first string;

the at least one additional string comprises at least one port on each of opposed sides of said isolation device and a closure for at least one port on one of said sides;

the at least one additional string comprises nested inner and outer strings and said at least one port on each of opposed sides of said isolation device are located on spaced ported subs communicating to an annular space between said inner and outer strings;

relative movement between said inner and outer strings causes said closure to close said at least one port on one of said sides;

said relative movement is longitudinal movement of said inner string;

said outer string comprises a lower seal bore below said ported sub in said lower zone and an upper seal bore above said ported sub in said upper zone;

said inner string comprises a seal assembly for selective positioning in said seal bores.

9. The assembly of claim 8, wherein:

said ports in said ported subs are open when said seal assembly is in said lower seal bore such that a flow path through said annular space extends through said isolation device to reach said first string.

10. The assembly of claim 9, wherein:

said outer string comprises a first landing shoulder for a first no go on said inner string to land on to position said seal assembly in said lower seal bore.

11. The assembly of claim 10, wherein:

shifting said seal assembly causes said closure to close said at least one port on one of said sides.

12. A completion assembly for a wellbore, comprising a first string extending at least part way into a wellbore;

at least one additional string extending further into the wellbore and supporting an isolation device that divides the wellbore into an upper zone where said first string is disposed without contact of said isolation device and a lower zone exposed to a formation, said at least one additional string selectively allowing flow through said isolation device;

said at least one additional string extends through said isolation device and selectively allows flow through itself to bypass said isolation device and reach said first string;

said at least one additional string comprises at least one port on each of opposed sides of said isolation device and a closure for at least one port on one of said sides;

said at least one additional string comprises a nested inner and outer strings and said at least one port on each of opposed sides of said isolation device are located on spaced ported subs communicating to an annular space between said inner and outer strings;

the port on at least one of said ported subs is selectively closed by longitudinal movement of said inner string;

said outer string comprises a lower seal bore below said ported sub in said lower zone and an upper seal bore above said ported sub in said upper zone;

said inner string comprises a seal assembly for selective positioning in said seal bores;

said ports in said ported subs are open when said seal assembly is in said lower seal bore such that a flow path through said annular space extends through said isolation device to reach said first string;

said outer string comprises a first landing shoulder for a first no go on said inner string to land on to position said seal assembly in said lower seal bore;

at least one of said ported subs has its ports closed as said seal assembly is shifted from said lower to said upper seal bore;

said outer string comprises a second landing shoulder for a second no go on said inner string to contact to position said seal assembly in said upper seal bore.

13. The assembly of claim 12, wherein:

at least one of said ported subs comprises a sliding sleeve operated by a shifting tool on said inner string.

14. The assembly of claim 13, wherein:

said first string comprises a production string with an electric submersible pump;

said inner string further comprises an instrument string that extends through said inner string;

said isolation device comprises a skirt supporting a liner with openings wherein said liner is sealed to said skirt on one side and to a surrounding casing on an opposite side.

15. The assembly of claim 14, wherein:

longitudinal movement of said instrument string with respect to said outer string selectively isolates said upper and lower zones to allow pulling the electric submersible pump without killing the well in said lower zone.

16. A completion assembly for a wellbore, comprising a first string extending at least part way into a wellbore;

at least one additional string extending further into the wellbore and supporting an isolation device that divides the wellbore into an upper zone where said first string is disposed without contact of said isolation device and a lower zone exposed to a formation and where said first string does not extend, said at least one additional string selectively allowing flow through said isolation device to reach adjacent a lower end of said first string;

said first string comprises a production string with an electric submersible pump;

said at least one additional string comprises a concentric string comprising an instruments string extending through a guide string;

said isolation device comprises a skirt supporting a liner with openings wherein said liner is sealed to said skirt on one side and to a surrounding casing on an opposite side.

17. The assembly of claim 16, wherein:

longitudinal movement of said instruments string with respect to said guide string selectively isolates said upper and lower zones to allow pulling the electric submersible pump without killing the well in said lower zone.

18. The assembly of claim 17, wherein:

said guide string comprises at least one port on each of opposed sides of said isolation device and a closure for at least one port on one of said sides, said at least one port on each of opposed sides of said isolation device comprises spaced ported subs communicating to an annular space between said first and said at least one additional string.

19. The assembly of claim 18, wherein:

said guide string comprises a lower seal bore below said ported sub in said lower zone and an upper seal bore above said ported sub in said upper zone;

said concentric string comprises a seal assembly for selective positioning in said seal bores;

said ports in said ported subs are open when said seal assembly is in said lower seal bore such that a flow path through said annular space extends through said isolation device to reach said first string;

at least one of said ported subs has its ports closed as said seal assembly is shifted from said lower to said upper seal bore.

20. A completion assembly for a wellbore, comprising a first string extending at least part way into a wellbore;

at least one additional string extending further into the wellbore and supporting an isolation device that divides the wellbore into an upper zone where said first string is disposed without contact of said isolation device and a lower zone exposed to a formation, said at least one additional string selectively allowing flow through said isolation device;

said first string comprises a production string with an electric submersible pump;

said at least one additional string comprises a concentric string that can have an instruments string extending through a guide string;

said isolation device comprises a skirt supporting a liner with openings wherein said liner is sealed to said skirt on one side and to a surrounding casing on an opposite side;

longitudinal movement of said instruments string with respect to said guide string selectively isolates said upper and lower zones to allow pulling the electric submersible pump without killing the well in said lower zone;

said guide string comprises at least one port on each of opposed sides of said isolation device and a closure for at least one port on one of said sides, said ports on opposed sides of said isolation device are located on spaced ported subs communicating to an annular space between said first and said additional string;

said guide string comprises a lower seal bore below said ported sub in said lower zone and an upper seal bore above said ported sub in said upper zone;

said concentric string comprises a seal assembly for selective positioning in said seal bores;

said ports in said ported subs are open when said seal assembly is in said lower seal bore such that a flow path through said annular space extends through said isolation device to reach said first string;

at least one of said ported subs has its ports closed as said seal assembly is shifted from said lower to said upper seal bore;

said guide string comprises a first landing shoulder for a first no go on said concentric string to land on to position said seal assembly in said lower seal bore;

said guide string comprises a second landing shoulder for a second no go on said instrument string to contact to position said seal assembly in said upper seal bore.

* * * * *

UNITED STATES PATENT AND TRADEMARK OFFICE

CERTIFICATE OF CORRECTION

PATENT NO. : 8,215,399 B2
APPLICATION NO. : 12/141398
DATED : July 10, 2012
INVENTOR(S) : Terry R. Bussear It is certified that error appears in the above-identified patent and that said Letters Patent is hereby corrected as shown below:

Title page, illustrative fig(s). 1-2 should be deleted and substitute therefore the attached title page Consisting of illustrative fig(s) 1-2.

In the Drawings

Fig(s) 1-4 should be deleted and substitute therefore figures 1-4 as shown on pages 3-4 of the attached pages.

Signed and Sealed this
Eleventh Day of September, 2012

David J. Kappos

David J. Kappos
*Director of the United States Patent and Trademark Office*

(12) United States Patent
Bussear et al.

(10) Patent No.: US 8,215,399 B2
(45) Date of Patent: Jul. 10, 2012

(54) DOWNHOLE SHUT OFF ASSEMBLY FOR ARTIFICIALLY LIFTED WELLS

(75) Inventors: Terry R. Bussear, Spring, TX (US); Kirk J. Huber, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 12/141,398

(22) Filed: Jun. 18, 2008

(65) Prior Publication Data

US 2009/0314499 A1 Dec. 24, 2009

(51) Int. Cl.
*E21B 33/12* (2006.01)

(52) U.S. Cl. ..... 166/313; 166/184; 166/334.1; 166/381

(58) Field of Classification Search ..... 166/51, 166/77, 89.1, 131, 184, 191, 313, 334.1, 166/381, 77.1, 143, 133, 188, 97.5
See application file for complete search history.

(56) References Cited

U.S. PATENT DOCUMENTS

| | | | | |
|---|---|---|---|---|
| 3,115,187 | A * | 12/1963 | Brown | 166/316 |
| 3,799,268 | A * | 3/1974 | Cochran | 166/313 |
| 4,440,221 | A * | 4/1984 | Taylor et al. | 166/106 |
| 4,440,231 | A | 4/1984 | Martin | |
| 4,682,655 | A | 7/1987 | Rivas | |
| 5,024,275 | A | 6/1991 | Anderson et al. | |
| 5,320,176 | A | 6/1994 | Naquin | |
| 6,119,780 | A * | 9/2000 | Christmas | 166/313 |
| 6,328,111 | B1 | 12/2001 | Bearden et al. | |
| 6,415,864 | B1 | 7/2002 | Ramakrishnan et al. | |
| 7,228,914 | B2 * | 6/2007 | Chavers et al. | 166/386 |
| 2005/0092501 | A1 * | 5/2005 | Chavers et al. | 166/386 |
| 2008/0223585 | A1 * | 9/2008 | Patel et al. | 166/385 |

OTHER PUBLICATIONS

Robison, C.E., et al., "An Alternative Method of Installing ESP's" SPE 25571, Apr. 1993, 455-464.
Dinkins, Walter, et al, "Thur-Tubing Conveyed ESP Pump Replacement—Live Well Intervention", SPE 116822, Sep. 2008, 1-15.
Patterson, John C., et al., "First 4.5-" Through-Tubing SPE with Downhole Wet Connect", SPE 123996, Oct. 2009, 1-13.

* cited by examiner

*Primary Examiner* — William P Neuder
*Assistant Examiner* — Robert E Fuller
(74) *Attorney, Agent, or Firm* — Steve Rosenblatt

(57) ABSTRACT

A multi-string well has an electric submersible pump (ESP) that can be removed without killing the well. A slotted liner is sealingly secured externally to casing and internally to a guide string that remains in the wellbore when the ESP is removed. A ported sub is part of the guide string and a concentric screen that can have instruments that moves relatively to the guide string can selectively allow flow in an annulus between them and to the ported sub or that annulus between the guide and concentric strings can be blocked off by manipulation of the concentric string to close the ported sub. With the lower portion of the well now blocked off, the wellhead can be removed so that the ESP can come out with the production string. The device has particular application to steam assisted gravity drainage (SAGD) systems as well as other downhole applications.

20 Claims, 2 Drawing Sheets

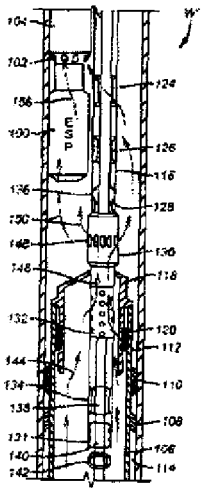

FIG. 1

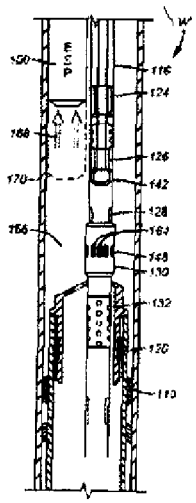

FIG. 2